US006908073B1

(12) United States Patent
Hsien

(10) Patent No.: US 6,908,073 B1
(45) Date of Patent: Jun. 21, 2005

(54) HAND WINCH HAVING A REMOVABLE SWAY HANDLE

(76) Inventor: Ching-Fong Hsien, P.O. Box 697, Feng-Yuan City, Taichung Hsien (TW) 420

( * ) Notice: Subject to any disclaimer, the term of this patent is extended or adjusted under 35 U.S.C. 154(b) by 0 days.

(21) Appl. No.: 10/782,332

(22) Filed: Feb. 20, 2004

(51) Int. Cl.[7] ..... B25B 25/00
(52) U.S. Cl. ..... 254/218; 81/438; 16/422
(58) Field of Search ..... 254/217, 218, 254/238; 81/177.1, 489, 438; 16/110.1, 422

(56) References Cited

U.S. PATENT DOCUMENTS 4,235,420 A * 11/1980 Ross et al. ..... 254/218
6,076,805 A * 6/2000 Messersmith ..... 254/218
6,799,750 B2 * 10/2004 Chen ..... 254/218
6,808,164 B2 * 10/2004 Chang ..... 254/217
2004/0083575 A1 * 5/2004 Chou ..... 16/110.1

* cited by examiner

*Primary Examiner*—Emmanuel Marcelo

(57) ABSTRACT

A hand winch having a removable sway handle includes a main body having a winding drum and a plurality of ratchet teeth thereon for winding a cable, a subordinate hook secured to one end of the main body, a main hook suspended from the distal portion of the cable which is fastened to the other end of the main body, a sway handle a tongs shaped front portion composed of a pair of symmetrical prongs each of which has a concave respectively engaged with the main axis and rotatably fixed by a pair of movable plates in cooperation with a pair of elastic members each of which has a cap protruded to outside of the prongs and engaged with a circular through hole of the movable plates, a check pawl engaged within the ratchet teeth and rotatably operated by a lever in the tongs shaped front portion. Thereby, press inward of the caps to set the movable plate free to rotate in order to permit the sway handle readily removed from the main body.

1 Claim, 9 Drawing Sheets

HAND WINCH HAVING A REMOVABLE SWAY HANDLE

BACKGROUND OF THE INVENTION

The present invention relates to hand winch and/or capstan and more particularly to a hand winch having a removable sway handle.

A hand winch is useful to drag a car, a boat, a heavy machine and/or to bind the timbers. FIG. 1 shows a prior art hand winch 10 which comprises a winding drum 11 for winding the cable 12, a plurality of single direction ratchet teeth 13 on a lateral side, a sway handle 14 having a check pawl 141 which checks the ratchet teeth upon the operation of the sway handle 14, a main hook 15 and a subordinate hook 16 respectively connected with two ends of the cable 12. In operation, the main hook 15 hooks a rope which is supposedly fastened on a post and the subordinate hook 16 hooks another rope which is supposedly fastened on a heavy machine. Then press the check pawl 141 downward to engage with one of the ratchet teeth 13 and sways the sway handle 14 to and fro so as to gradually move the machine step by step. However, this type of the hand winch 10 has a large volume, especially its long sway handle 14 occupies a large space causing difficulty to pack for transportation.

SUMMARY OF THE PRESENT INVENTION

The present invention has a main object to provide a hand winch having a removable sway handle which is readily assembled and/or disassembled in order to reduce the volume of hand winch for a convenient and economic packing on transportation.

Accordingly, the hand winch of the present invention comprises generally a main body, a winding drum rotatably secured is the main body by main axis, a plurality of single direction ratchet teeth on one side of the drum, a tongs shaped removable sway handle pivoted to the main body having a check pawl engageable with the ratchet teeth to operate the winding drum. The sway handle has a concave in the end of each of prong of the tongs made engageable with the axis, a pair of movable plates respectively disposed on the outside of the prongs each having positioning hole respectively sleeved on the caps of a pair of elastic members inside the prongs and a check slot engaged with the concaves of the prongs. So that the elastic members fixed the movable plates which are unable to rotate but their check slots close the concaves of the prongs to pivotally connect the sway handle onto the main axis without breakaway. When press the elastic members to disengage with positioning hole of the movable plates which can be rotate that the check slots are now longer closed the concaves of prongs. Therefore, enables the sway handle to remove from the main body.

The present invention will become more fully understood by reference to the following detailed description there of when read in conjunction with the attached drawings.

DETAILED DESCRIPTION OF THE PREFERRED EMBODIMENT

Figure 1:
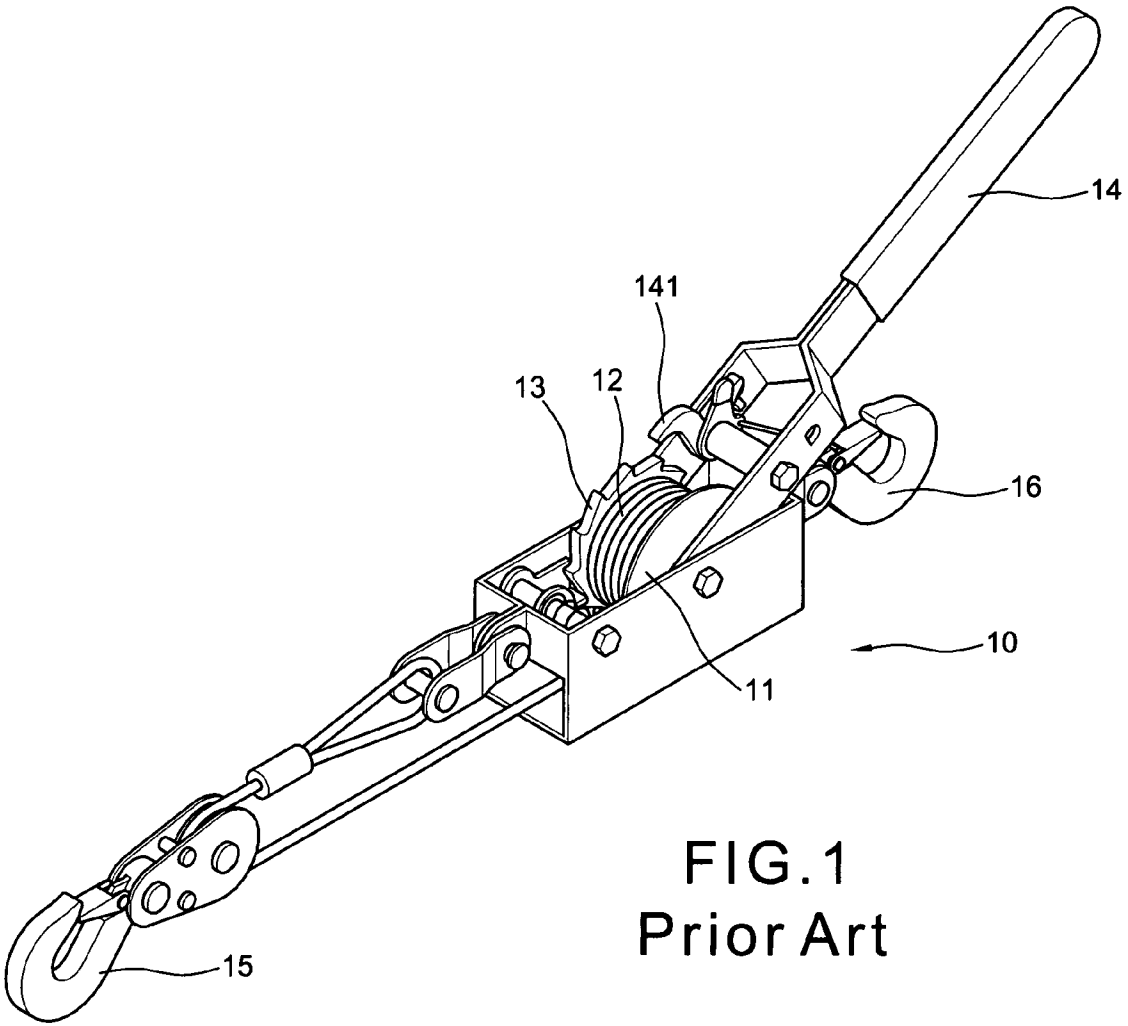
FIG. 1 Prior Art
FIG. 1 is a perspective view of a hand winch according to a prior art.
Figure 2:
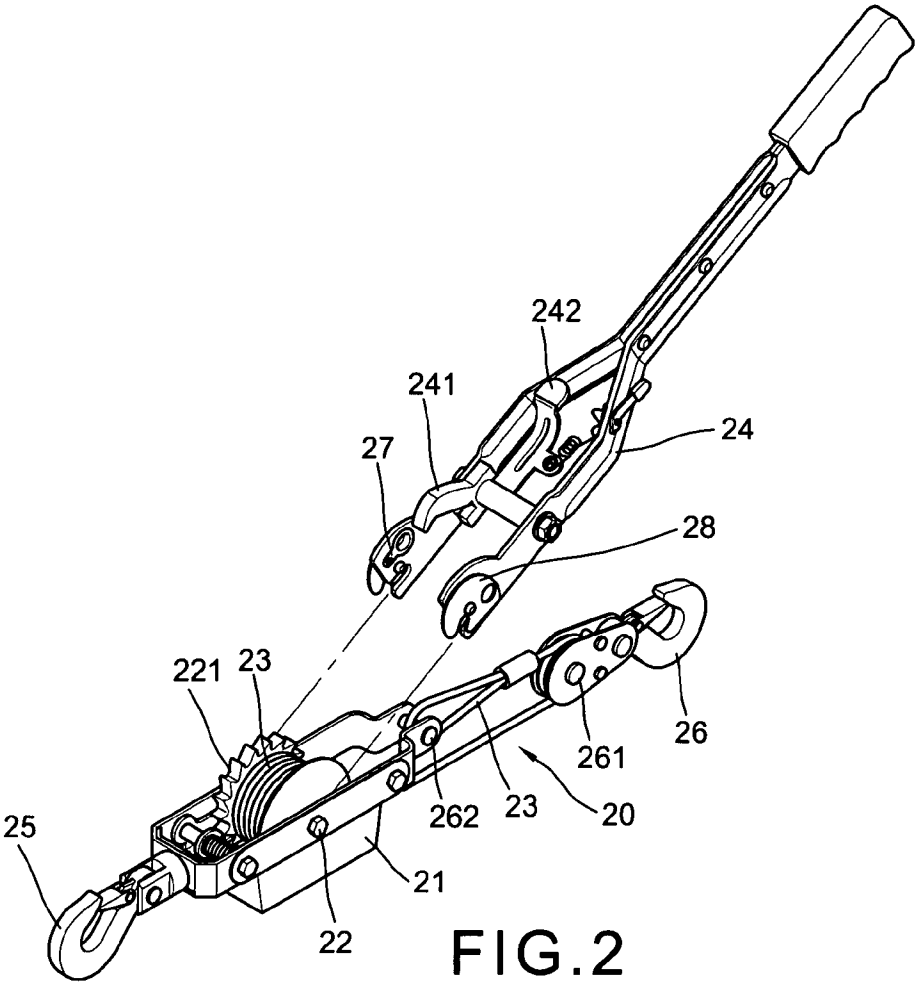
FIG. 2 is an exploded perspective view to show a hand winch of the preferred embodiment of the present invention.
Figure 3:
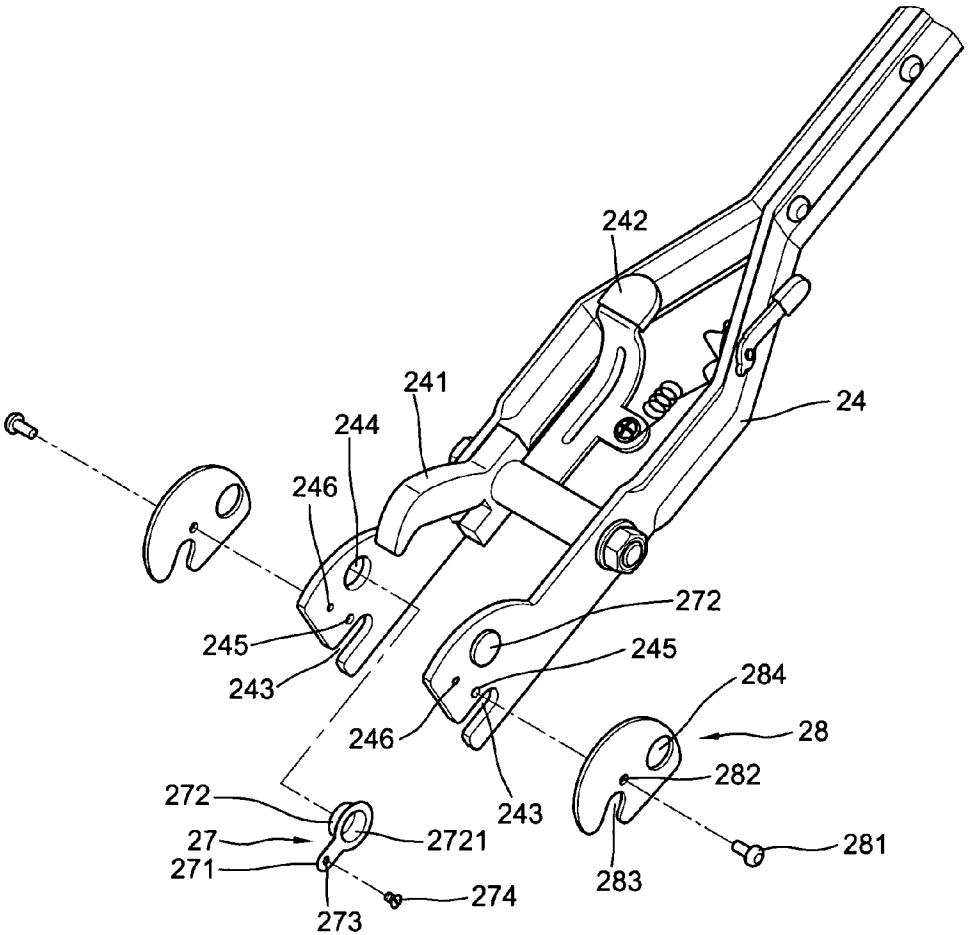
FIG. 3 is an exploded perspective view of a removable sway handle of the present invention.
Figure 4:
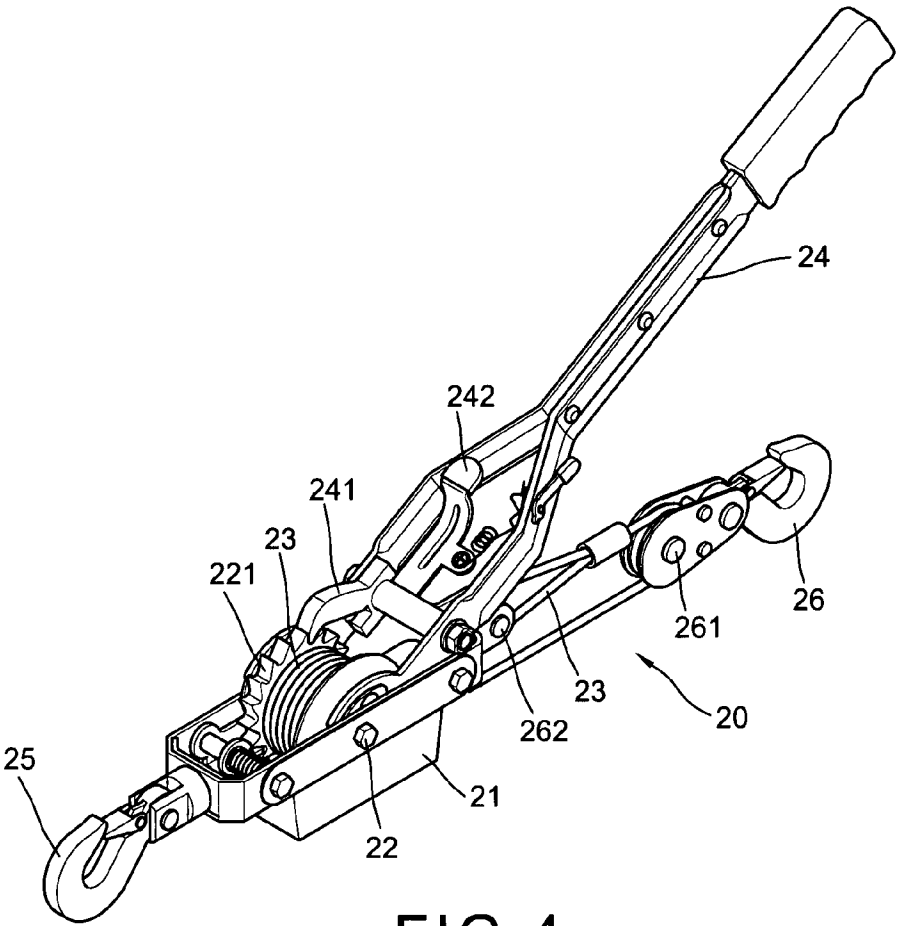
FIG. 4 is a perspective view of the assembly of the hand winch according to the present invention.
Figure 5:
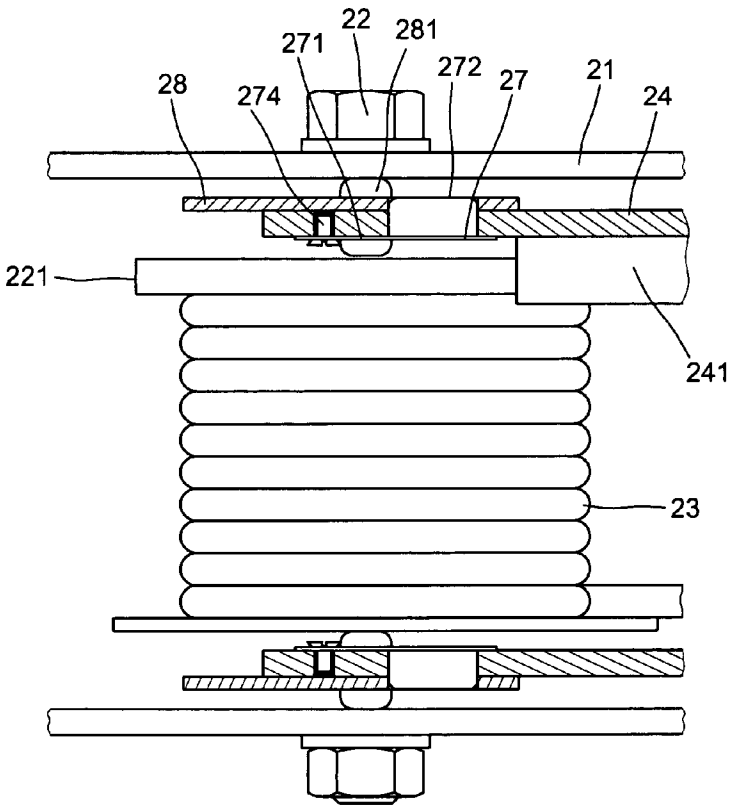
FIG. 5 is a sectional view indicating the pivotal connection of the sway handle with the main axis.
Figure 6:
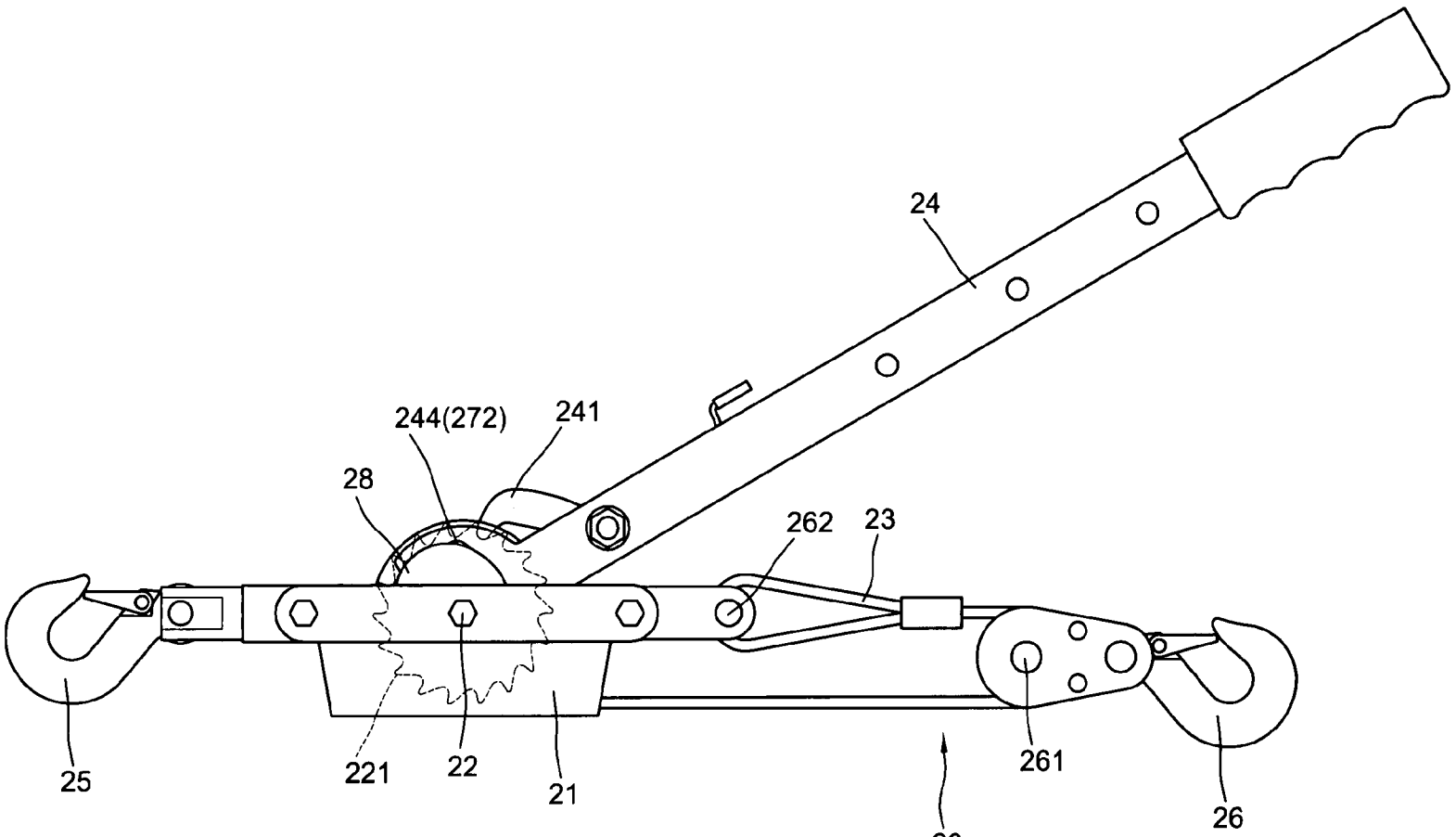
FIG. 6 is a side view of the hand winch of the present invention.
Figure 7:
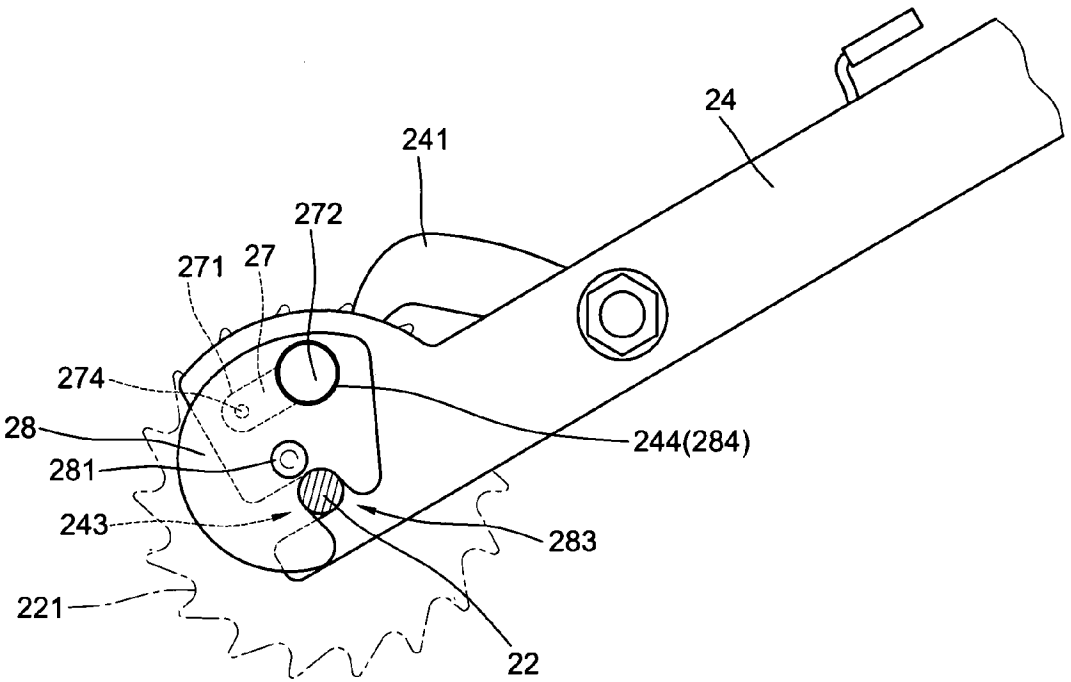
FIG. 7 is a side view of the sway handle connected with the main axis.

With reference to the drawings and initiated from FIGS. 2, 3 and 4, the hand winch 20 of the present invention comprises a main body 21, a main axis 22 having a winding drum thereon for winding a cable 23 and plurality of ratchet teeth 221 of single direction on a lateral side, a tongs shaped sway handle 24 removable pivoted to the main axis 22. The sway handle has a check pawl 241 pivoted to a transverse rod engageable within the teeth 221 and operated by a lever 242 which is positioned under the check pawl 241 and connected to an inner side of a prong of the sway handle 24 by a spring, a U-shaped concave 243 in the front end of each of the prongs of the sway handle 24, a small hole 245 above the concaves 243, a circular through hole 244 and a screw hole 246 spacedly formed above the small holes 245. A pair elastic members 27 each having an elastic plate 271, a cap 272 including an opening 2721 in inner side respectively engaged within the circular through holes 244 from the inner side of the prongs of the sway handle 24, a screw hole 273 engaged with the screw holes 246 of the sway handle 24 and secured by the screws 274. A pair of movable plates 28 each has a check slot 283 in front end engaged with the concaves 243, a positioning hole 284 adjacent rear end engaged with the caps 272 of the elastic members 27 and a through hole 282 in central portion engaged with the small holes 245 respectively secured by a pair rivets 281 on outside of the prongs of the sway handle 24. So that the sway handle 24 is rotatably secured to the main axis 22 of the main body 21 due to that the check slots 283 of the movable plates 28 blocks the concaves 243 of the sway handle 24 (as show in FIGS. 5, 6 and 7). A subordinate hook 25 secures to one end of the main body 21 and a main hook 26 connects to the other end of the main body 21 via the cable 23 which has distal portion surrounding a pulley 261 the secured to a transverse bar 262 of the main body 21.

In operation, hook the subordinate hook 25 to a rope of a post and the main hook 26 to a rope of a heavy working object, then pull the lever 242 up to have the check pawl 241 engaged within the ratchet teeth and then sway the sway handle to and fro to rotate the winding drum of the main axis 22, the working object be therefore gradually moved in. Because of that the concaves 243 is blocked by the front end of the movable plates 28, the sway handle is tightly secured to the main axis 22 without breakaway.

Figure 8:
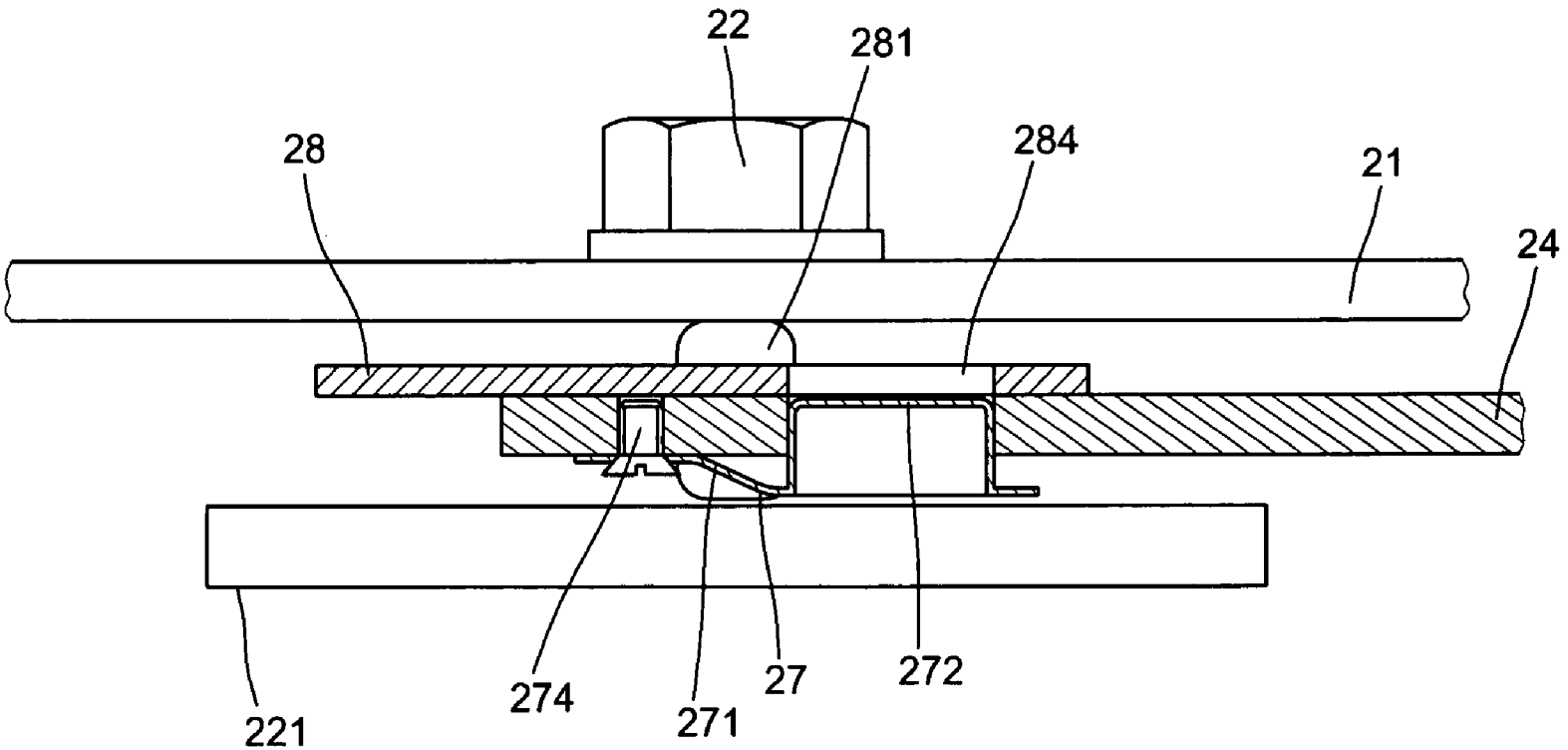
FIG. 8 is a top sectional view of FIG. 7.
Figure 9:
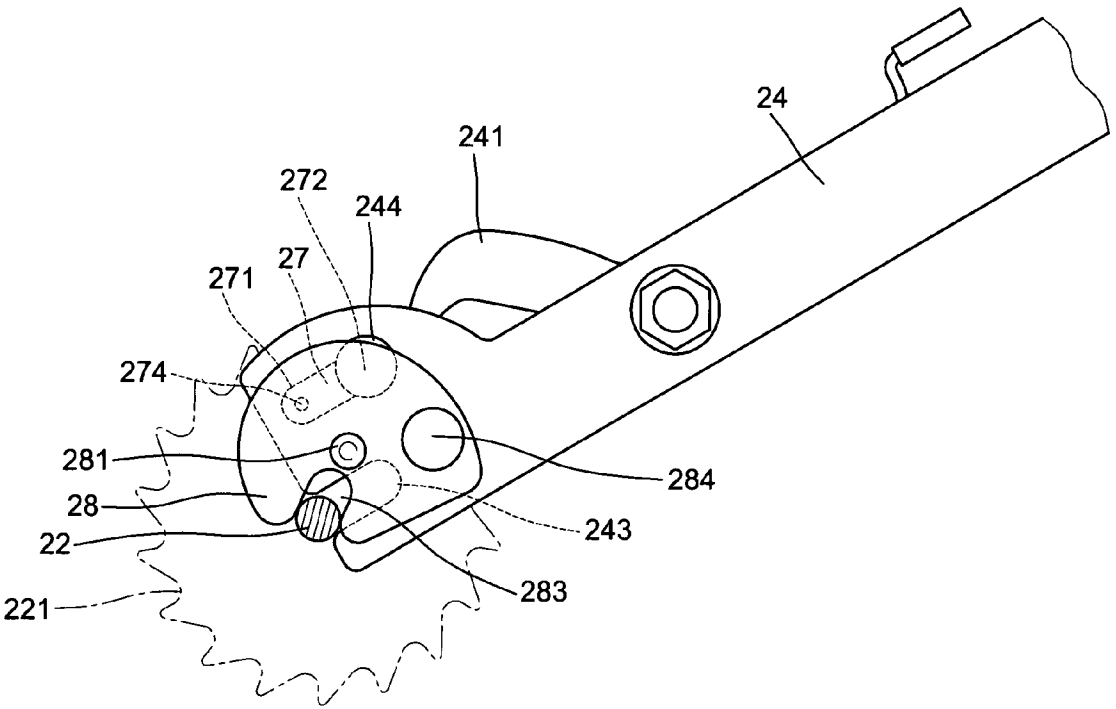
FIG. 9 is a side view indicating that the sway handle is removable from the main axis.

Referring to FIGS. 8 and 9 of the drawings, if press the caps 272 of the elastic members 27 inward, the positioning hole of the movable plates are disengaged with the caps 272 to enable the movable plates 28 to rotate freely on the rivets 281 and not to block the concaves 243. So that the sway handle is readily removed from the main axis 22.

The hand winch 20 of the present invention is featured on the removable sway handle 24 which is provided not only easy to assemble but also readily to disassemble from the main body 21. So that it saves great deal of space to pack for transportation. There novelty and progression are patentably over the prior art.

Note that the specification relating to the above embodiment should be construed as an exemplary rather than as a limitative of the present invention, with many variations and modifications being readily attainable by a person of average skill in the art without departing from the spirit or scope there of as defined by the appended claims and their legal equivalents.

I claim:

1. A hand winch having a removable sway handle comprising:

a main body having a main axis with a winding drum thereon for winding a cable, a plurality of ratchet teeth of single direction abutting a lateral side of said winding drum, a subordinate hook secured to one end thereof and a main hook including a pulley in rear end connected to said cable which has a distal portion surrounding said pulley and fastened to a transverse bar at other end of said main body;

a sway handle removably and rotatably secured to the main axis of said main body having a tongs shaped front portion composed of a pair of symmetrical prongs each of which has a concave in fore end, a small hole above the concave, a circular through hole and a screw hole spacedly formed above the small hole, a check pawl rotatably connected to an axial rod engageable with said ratchet teeth and a lever positioned under said check pawl and connected with a spring from one of said prongs for operating said check pawl;

a pair of elastic members each having an elastic plate including a screw hole adjacent a free end respectively engaged with the screw holes of said prongs and secured by a pair of screws from an inner side of said prongs and a cap with an opening in an inner side releasably engaged with the circular through hole from the inner side of said prongs;

a pair movable plates rotatably secured to the outside of said prongs by a pair of rivets and each having a though hole in a center engaged with the small hole of said prongs, a positioning hole adjacent one end engaged with the caps of said elastic members and a check slot in the other end respectively engaged with said main axis and blocking the concave of said prongs; and whereby, press said caps inward to set said movable plates free to rotate to permit said sway handle readily removes from said main body.

* * * * *